United States Patent [19]

Fürst et al.

[11] Patent Number: 4,564,428

[45] Date of Patent: Jan. 14, 1986

[54] AMMONIATED ETCHING SOLUTION AND PROCESS FOR ITS REGENERATION UTILIZING AMMONIUM CHLORIDE ADDITION

[75] Inventors: Leander Fürst, Jülich; Walter Holzer, Meersburg; Bertel Kastening, Hamburg, all of Fed. Rep. of Germany

[73] Assignee: Kernforschungsanlage Jülich Gesellschaft mit beschränkter Haftung, Jülich, Fed. Rep. of Germany

[21] Appl. No.: 624,585

[22] Filed: Jun. 26, 1984

[30] Foreign Application Priority Data

Jul. 7, 1983 [DE] Fed. Rep. of Germany ..... 3324450

[51] Int. Cl.[4] ..... C25C 1/12

[52] U.S. Cl. ..... 204/107; 204/108; 204/130; 252/79.1

[58] Field of Search ..... 204/130, 105 R, 106, 204/107, 108; 252/79.1

[56] References Cited

U.S. PATENT DOCUMENTS

| | | | |
|---|---|---|---|
| 4,269,678 | 5/1981 | Faul et al. | 204/130 |
| 4,280,887 | 7/1981 | Konstantouros | 204/130 |
| 4,385,969 | 5/1983 | Kastening et al. | 204/105 R |

FOREIGN PATENT DOCUMENTS

| | | | |
|---|---|---|---|
| 56-10677 | 12/1981 | Japan | 252/79.2 |

*Primary Examiner*—R. L. Andrews

*Attorney, Agent, or Firm*—Frishauf, Holtz, Goodman & Woodward

[57] ABSTRACT

The addition of a small quantity of ammonium chloride to an ammonium sulfate etching solution results in shortening the regeneration time of the spent etching solution when air or oxygen is bubbled through it to reoxidize it, and it also results in accelerating the etching rate. The extent of this improvement deteriorates with increasing chlorine ion content, disappearing when the chlorine ion content substantially exceeds 0.4% by weight of the solution and still greater chlorine ion additions are distinctly undesirable. The electrolysis of the etching solution to remove etched-away metal cathodically produces enough oxygen at the anode to prevent any substantial evolution of chlorine from the electrolytic action on the small chlorine ion content.

9 Claims, 1 Drawing Figure

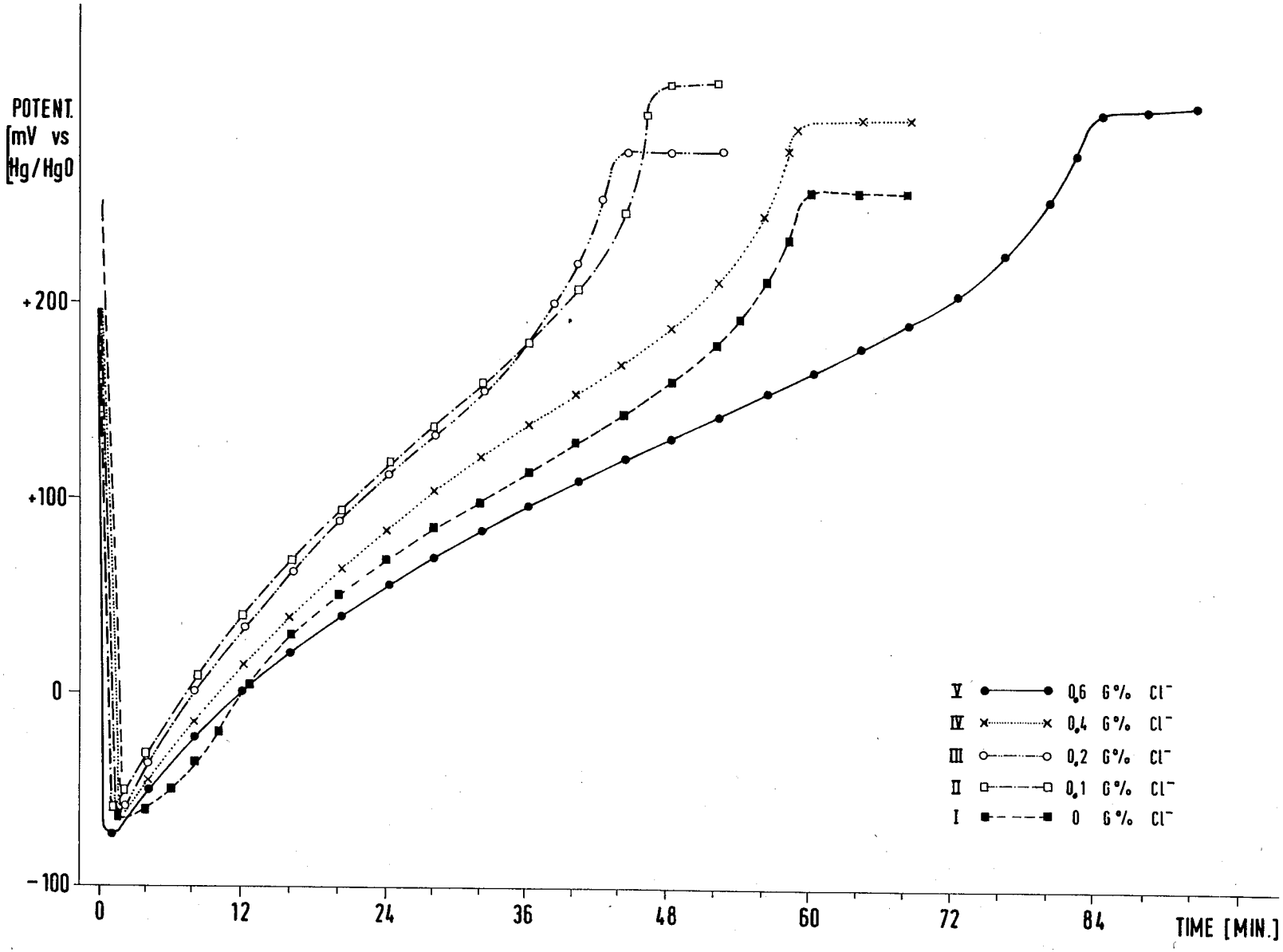
POTENT. [mV vs Hg/HgO]
+200
+100
0
-100
0
12
24
36
48
60
72
84
TIME [MIN.]
V 0,6 6% Cl⁻
IV 0,4 6% Cl⁻
III 0,2 6% Cl⁻
II 0,1 6% Cl⁻
I 0 6% Cl⁻

AMMONIATED ETCHING SOLUTION AND PROCESS FOR ITS REGENERATION UTILIZING AMMONIUM CHLORIDE ADDITION

This invention concerns ammoniated alkaline etching solutions, containing an etching agent and ammonium sulfate or other ammonium compounds incorporating an oxygen-containing anion, which can be regenerated by reoxidation of the etchant by contact with oxygen and from which the etched metal can be separated from the solution in an electrolysis cell through which at least a part of the solution is caused to flow and the process for regenerating such a solution.

Alkaline etchants such as alkaline ammoniated copper tetrammine salt solutions are used to etch metallic objects, especially for the manufacture of circuit boards such as are also known by the designation "printed circuits", especially when the circuit boards to be etched have metal portions which are not resistant to acid etchants, for example circuit board portions of lead, tin or nickel. Reoxidation of the alkaline etching solution after etching away of the metal is carried out with addition of ammonia gas and/or ammonium salt in the presence of oxygen or air.

It is known from U.S. Pat. No. 4,385,969, issued May 31, 1983, to suspend catalyst particles such as activated carbon powder in the etching solution which accelerate not only the etching itself, but also the reoxidation of the etching solution and thus dispense with the addition of chemical oxidizers that would lead to the formation of toxic residual solutions.

In that known process, the metal that has been etched away is separated in an electrolysis cell. for this purpose, only a part of the etched solution flows through the electrolysis cell. After the deposition of the metal, this portion of the solution is led back to the etching chamber as fresh etching solution and can be used as a rinsing solution for the circuit boards that need to have the catalyst particles cleaned off them after etching. The advantage of good copper separation in the electrolysis cell is at the cost of the disadvantage that the catalyst particles suspended in the etching solution need to be separated before entry of the solution into the electrolysis cell.

It is also known to etch circuit boards with the use of etching solutions containing ammonium chloride, as well as an alkaline copper ammine complex. If such a solution is introduced into an electrolysis cell for deposition of copper, there must be taken into account the decomposition of the electrolyte and the undesired evolution of chlorine at the anode.

SUMMARY OF THE INVENTION

It is an object of the present invention to provide an alkaline ammoniated etching solution with which, without addition of suspended catalyst particles, not only will the regeneration of the etching solution be accelerated, but also it will be possible to deposit etched-away copper in an electrolysis cell with extensive oxygen evolution at the anode, so that decomposition of the electrolyte and evolution of chlorine will be substantially prevented.

Briefly, the etching solution contains an etching agent and mostly ammonium sulfate or another ammonium salt incorporating an oxygen-containing anion, made alkaline with ammonia, in which, according to the invention, a small amount of chlorine ion, preferably provided by an addition of ammonium chloride, namely 0.05 to 0.4% by weight of chlorine is present. The amount of chlorine ion (sometimes referred to as chloride ion) is preferably between 0.1 and 0.3% by weight of the etching solution.

It has been found that the addition of chloride to the etching solution accelerates regeneration if the chlorine ion concentration is set at a value not higher than 0.4% by weight. Any further addition of chloride causes the regeneration speed to deteriorate below the regeneration speed of an etchant utilizing pure ammonium sulfate solution with copper tetrammine sulfate. With much higher chlorine ion content, the regeneration again increases, but in that case the above-described disadvantages of using ammonium chloride etching solutions again appear strongly.

The process of regenerating a solution constituted in accordance with the invention operates at satisfactory speed without the addition of solid catalyst particles when oxygen is supplied either by itself or in air to the solution and at least a part of the solution is caused to flow through an electrolysis cell for deposition of etched-away metal out of the solution. As already mentioned, keeping the concentration of chlorine ion at a level no higher than 0.4% by weight of the solution, and preferably no more than 0.3% by weight, assures effective operation of the electrolytic separation of etched-away copper without decomposition of the electrolyte or any substantial evolution of chlorine.

BRIEF DESCRIPTION OF THE DRAWING

The invention is further described by way of illustrative example with reference to the annexed drawing, the single FIGURE of which is a graph showing the potential of the solution measured at room temperature by a platinum rod against a mercury/mercury oxide reference electrode, plotted against regeneration time.

DESCRIPTION OF THE ILLUSTRATED EXAMPLE

A solution containing 150 g of ammonium sulfate and 50 g of copper per liter was set at a pH value of 9.5 by addition of gaseous ammonia. Air was bubbled through the solution for oxidation. The potential of the solution was measured at room temperature by means of a platinum rod against a mercury/mercury oxide reference electrode.

Then 20 g of copper powder was dissolved in the solution, which had the result of lowering the potential in the solution by 330 millivolts (mV). The time course of the potential in the etching solution during its regeneration is shown in the drawing by curve I. The end potential of 260 mV in the solution was reached after 60 minutes. The dissolved copper, of course, was in the form of copper tetrammine sulfate under these circumstances.

Thereafter various chlorine ion concentrations were provided by addition of ammonium chloride. The curves II through V show the regeneration of etching solutions with concentrations of chlorine ions from 0.1 to 0.6% by weight of chlorine ion in the solution. At the concentration of 0.1% by weight, the end potential value of 280 mV was already reached after forty-three minutes, in contrast to the results of the solution of curve I. A slight improvement was still shown with 0.4% by weight of chlorine ion in the solution. When the chlorine ion concentration was 0.6% by weight, however, the end potential was reached only after 84 minutes.

The invention is applicable not only for ammonium sulfate containing etching solutions, but also for etching solutions which, like the one just mentioned, contain oxygen-containing anions, such as, for example, etching solutions containing ammonium nitrate or ammonium carbonate. A similar effect is not likely when the oxygen-containing anion is a reducing agent, however, as in the case of sulfite or nitrite.

SECOND EXAMPLE

A further example shows that by the addition of chlorine ions the etching speed that can be obtained with the etching solution can also be increased. Thus, with an etching solution of 150 g per liter of ammonium sulfate and 80 g per liter of copper in the form of copper tetrammine sulfate, which had been set at a pH value of 9.2 by bubbling ammonium gas in, circuit boards bearing a copper layer were etched at a temperature of 40° C. The average etching speed obtained with this starting solution was 7.8 μm per minute. By the addition of ammonium chloride, 0.2% by weight of chlorine ions were additionally dissolved in the etching solution. With this etching solution, the etching speed was raised to 11.7 μm per minute. A further increase of chlorine ion concentration by the addition of ammonium chloride to a total content of 0.4% by weight increased the etching speed only slightly. The etching speed at this concentration was 12.3 μm per minute.

Although the invention has been described with reference to particular illustrative examples, it will be understood that variations and modifications are possible within the inventive concept.

We claim:

1. An alkaline-ammoniated etching solution containing an etching agent and an ammonium salt having an oxygen-containing anion which is not a reducing agent, said solution being capable, when spent, of being regenerated by supplying oxygen thereto and of having etched-away metal separated therefrom by circulation of at least a portion thereof through an electrolysis cell, said etchant incorporating the improvement comprising the presence therein of at least 0.05% and not more than 0.4% by weight of chlorine ion.

2. Etching solution according to claim 1, in which said ammonium salt is ammonium sulfate and said etching is an alkaline-ammoniated tetrammine salt.

3. Etching solution according to claim 2, in which said solution contains not less than 0.1% and not more than 0.3% by weight of chlorine ion and in which said tetrammine salt is a copper tetrammine salt.

4. Etching solution according to claim 1, in which said presence of chlorine ion in said solution is by virtue of ammonium chloride being dissolved in said solution.

5. Process for regenerating an etching solution containing an etching agent and an alkaline ammonium salt having an oxygen-containing anion which is not a reducing agent, comprising the steps of:

incorporating into said solution a quantity of chloride which produces a chlorine ion content in said solution not less than 0.05% and not more than 0.4% by weight;

passing a gas containing free oxygen through said solution for oxidation thereof, and electrolyzing at least a circulated portion of said solution through an electrolysis cell and thereby cathodically depositing etched-away metal out of said solution.

6. Process according to claim 5, in which said ammonium salt is ammonium sulfate and said etching agent is an alkaline-ammoniated metal tetrammine sulfate.

7. Process according to claim 5, in which said chloride is ammonium chloride.

8. Process according to claim 5, in which the step of incorporating chloride into said solution is performed before the use of said etching solution.

9. Process according to claim 5, in which the chlorine ion content of said solution, produced by the step of incoporating a quantity of chloride therein, is not less than 0.1% and not more than 0.3% by weight.

* * * * *